US007380744B1

(12) United States Patent
Yu Chen

(10) Patent No.: US 7,380,744 B1
(45) Date of Patent: Jun. 3, 2008

(54) MEMBRANE DISPENSER

(76) Inventor: Hsiu-Man Yu Chen, No. 40, Sec. 1, Ta Fu Road, Tan Tzu Hsiang Taichung (TW) 427

( * ) Notice: Subject to any disclaimer, the term of this patent is extended or adjusted under 35 U.S.C. 154(b) by 0 days.

(21) Appl. No.: 11/845,521

(22) Filed: Aug. 27, 2007

(51) Int. Cl.
*B65H 23/06* (2006.01)

(52) U.S. Cl. ..... 242/422.4; 242/588.2; 242/597.6

(58) Field of Classification Search ..... 242/422.4, 242/422.5, 588, 588.2, 597.6, 423.1
See application file for complete search history.

(56) References Cited

U.S. PATENT DOCUMENTS 4,706,442 A * 11/1987 Riemenschneider ..... 242/588.2
4,722,493 A * 2/1988 Parry et al. ..... 242/422.4
4,784,348 A * 11/1988 McDonald ..... 242/422.4
4,817,762 A * 4/1989 Powell ..... 242/422.4
4,834,312 A * 5/1989 Riemenschneider, III ..... 242/588.2
4,872,623 A * 10/1989 Parry et al. ..... 242/422.4
5,203,517 A * 4/1993 Parry et al. ..... 242/422.4
5,573,630 A * 11/1996 Edney et al.
6,102,323 A * 8/2000 Riemenschneider ..... 242/422.4
2006/0032965 A1 * 2/2006 Yu Chen ..... 242/422.4

* cited by examiner

*Primary Examiner*—William A Rivera
(74) *Attorney, Agent, or Firm*—Ming Chow; Sinorica, LLC

(57) ABSTRACT

A membrane dispenser includes a basic body having its intermediate circumference provided with a position-limiting recess to partition the basic body into a holding member at a rear portion and a dispensing member with a comparatively large diameter at a front portion. A position-limiting member is fitted in the position-limiting recess, and a brake sleeve is fitted on both the holding member and the position-limiting recess, which are engaged in the brake sleeve by the position-limiting member, letting the basic body able to rotate pivotally on the position-limiting member. In using, simply hold the brake sleeve and timely apply a radial force to the brake sleeve to force the basic body to stop rotating and let a membrane reel stop releasing membrane for facilitating adjusting of membrane strapping tightness, simple in structure and convenient in operating and using.

7 Claims, 5 Drawing Sheets

MEMBRANE DISPENSER

BACKGROUND OF THE INVENTION

1. Field of the Invention

This invention relates to a membrane dispenser, particularly to one able to timely stop a membrane reel from rotating and releasing membrane for facilitating adjustment of membrane strapping tightness, able to achieve excellent effect of membrane strapping.

2. Description of the Prior Art

A conventional membrane dispenser, as shown in FIG. 1, includes a basic body 1 having two circular holders 2 respectively and pivotally disposed at the opposite sides to face each other. A membrane reel 3 has opposite ends of its inner center respectively and pivotally assembled on the two circular holders 2 to enable the membrane reel 3 to be actuated to rotate between the two circular holders 2. However, the two holders 2 of the conventional membrane dispenser can only let the membrane reel 3 to rotate freely thereon, but cannot control tightness of the membrane released; therefore, during carrying out membrane strapping, it is necessary for a user to pay attention all the time to a strapping condition and manually adjust membrane strapping tightness. Thus, strapping tension of the membrane cannot be expanded effectively and an article strapping process becomes complicated, necessary to take much labor and time in membrane strapping.

For improving above-mentioned drawbacks, another conventional membrane dispenser, which can be manually operated with less force and convenience, enabling membrane strapping tension to be expanded, is disclosed in a U.S. Pat. No. 5,203,517. Such a membrane dispenser, as shown in FIG. 2, includes a solid columnar shaft 4 having its top end mounted with a wheel hub 5 properly inserted in an inner center of a membrane real 3. The solid columnar shaft 4 has a lower intermediate section disposed with a plurality of elongate projections 6 and secured with a brake sleeve 7 that cannot be rotated on the columnar shaft 4. Further, the columnar shaft 4 has its upper and lower side abutting the brake sleeve 7 respectively fitted thereon with a bearing 8 able to rotate on the columnar shaft 4 and its lower end fitted with a flexible grip sleeve 9. In using, when the solid columnar shaft 4 is driven to rotate in the bearings 8 and actuate the membrane reel 3 to carry out strapping, a radial force can be timely applied to the grip sleeve 9 to let the grip sleeve 9 push against the brake sleeve 7 to stop the columnar shaft 4 from rotating and force the membrane reel to stop releasing membrane and at this time, a user can carry out adjusting of membrane strapping tightness to let membrane strapping tension expanded effectively. However, the brake sleeve 7 has to be provided for pushing against the elongate projections 6 of the solid columnar shaft 4, and the two bearings 8 are necessary to be installed for actuating the solid columnar shaft 4 to rotate, thus complicating the structure of the membrane dispenser.

SUMMARY OF THE INVENTION

The objective of this invention is to offer a membrane dispenser including a basic body, a position-limiting member and a brake sleeve. The basic body is a long cylindrical body having its intermediate circumference provided with a position-limiting recess, which partitions the basic body into a holding member at a rear portion and a dispensing member at a front portion. The position-limiting member having an inner diameter a little larger than a circumference of the position-limiting recess is fitted in the position-limiting recess, and the brake sleeve made of flexible material is fitted on both the holding member and the position-limiting recess of the basic body. The brake sleeve is secured with a position-limiting edge at an inner circumferential edge of its opening end for restrictedly positioning the position-limiting member and engaging it in the brake sleeve, letting the basic body able to rotate pivotally in the position-limiting member. Further, the brake sleeve has its inner circumference disposed with a plurality of brake bars. Thus, a radial force can be timely imposed on the brake sleeve to let its brake bars stuck on the circumference of the basic body to stop a membrane reel from rotating for facilitating adjusting of membrane strapping tightness, convenient in operating and using and simply in structure.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
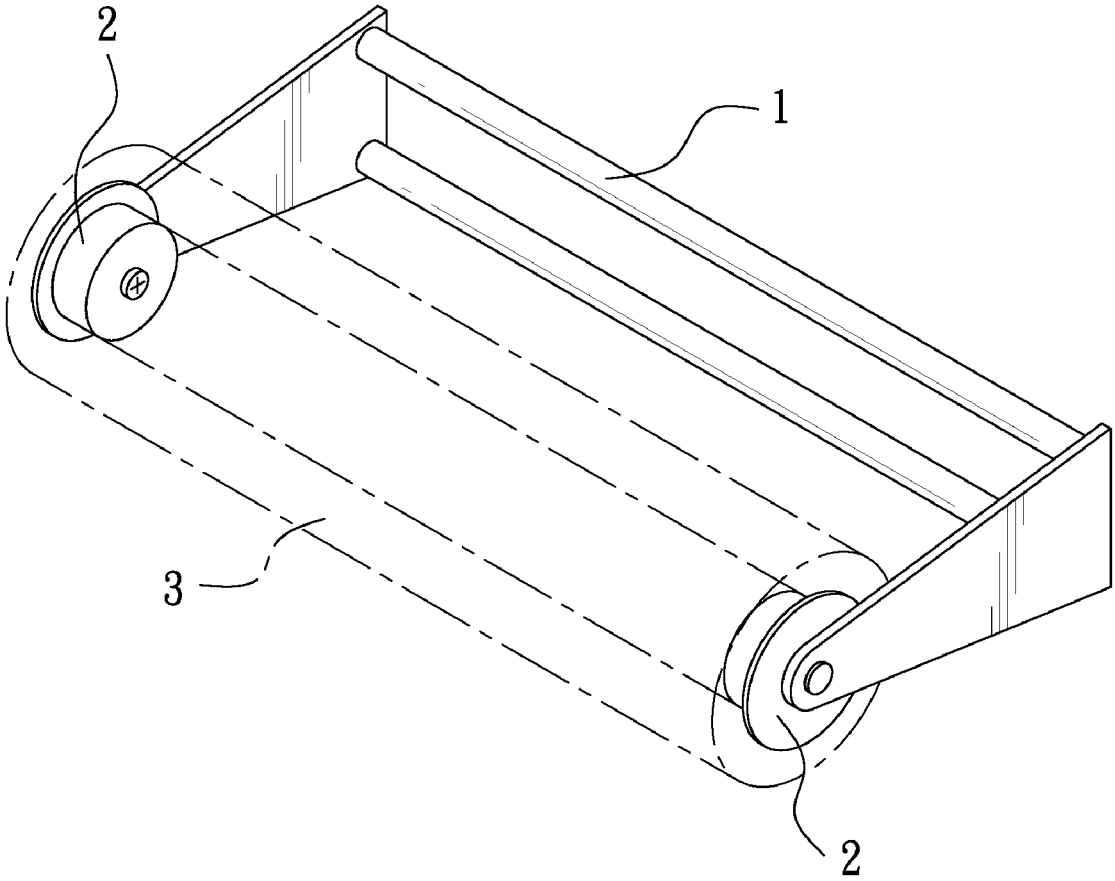
FIG. 1 PRIOR ART
FIG. 1 is a perspective view of a conventional membrane dispenser.
Figure 2:
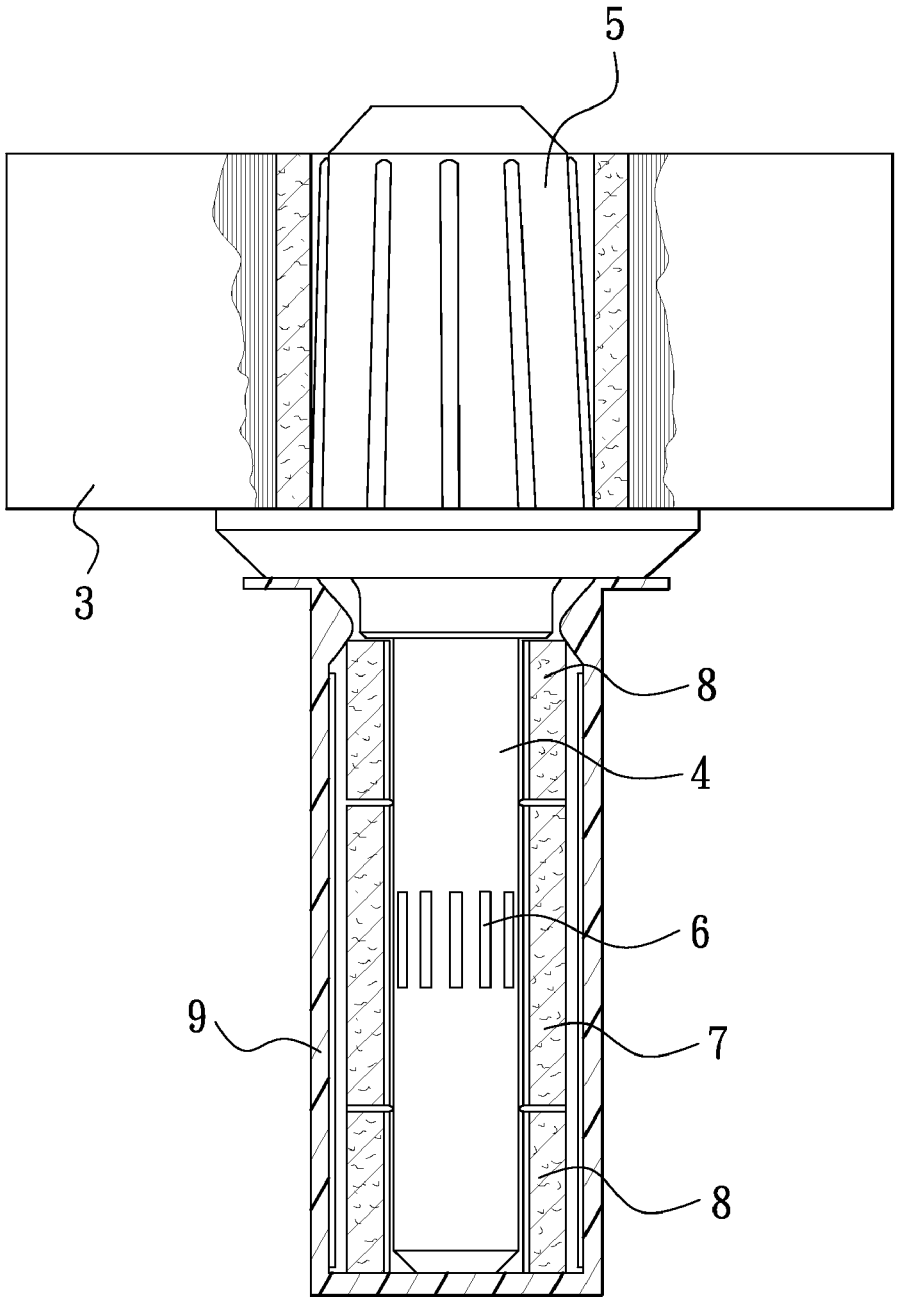
FIG. 2 PRIOR ART
FIG. 2 is a cross-sectional view of another conventional membrane dispenser.
Figure 3:
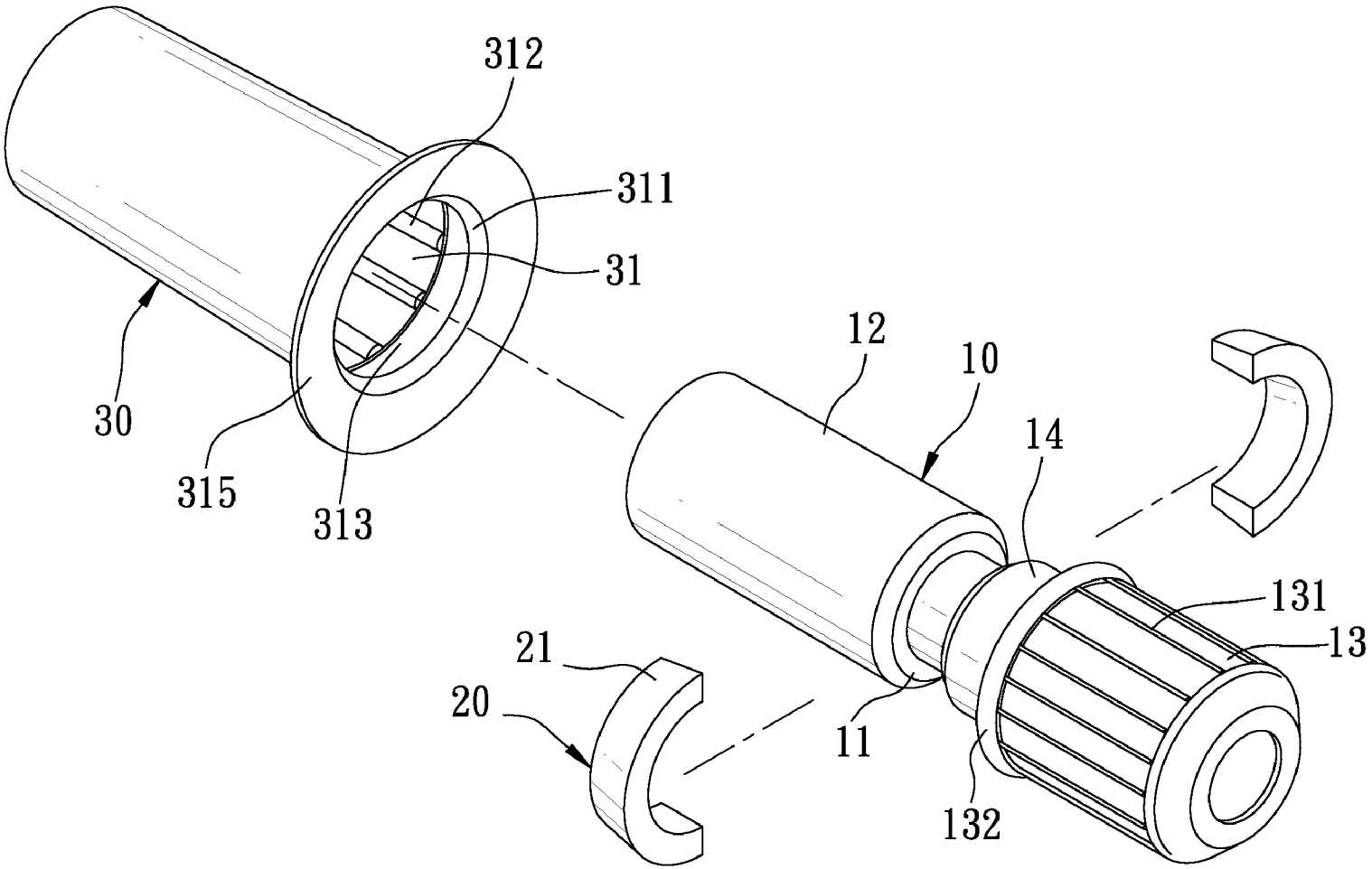
FIG. 3 is an exploded perspective view of a membrane dispenser in the present invention.
Figure 4:
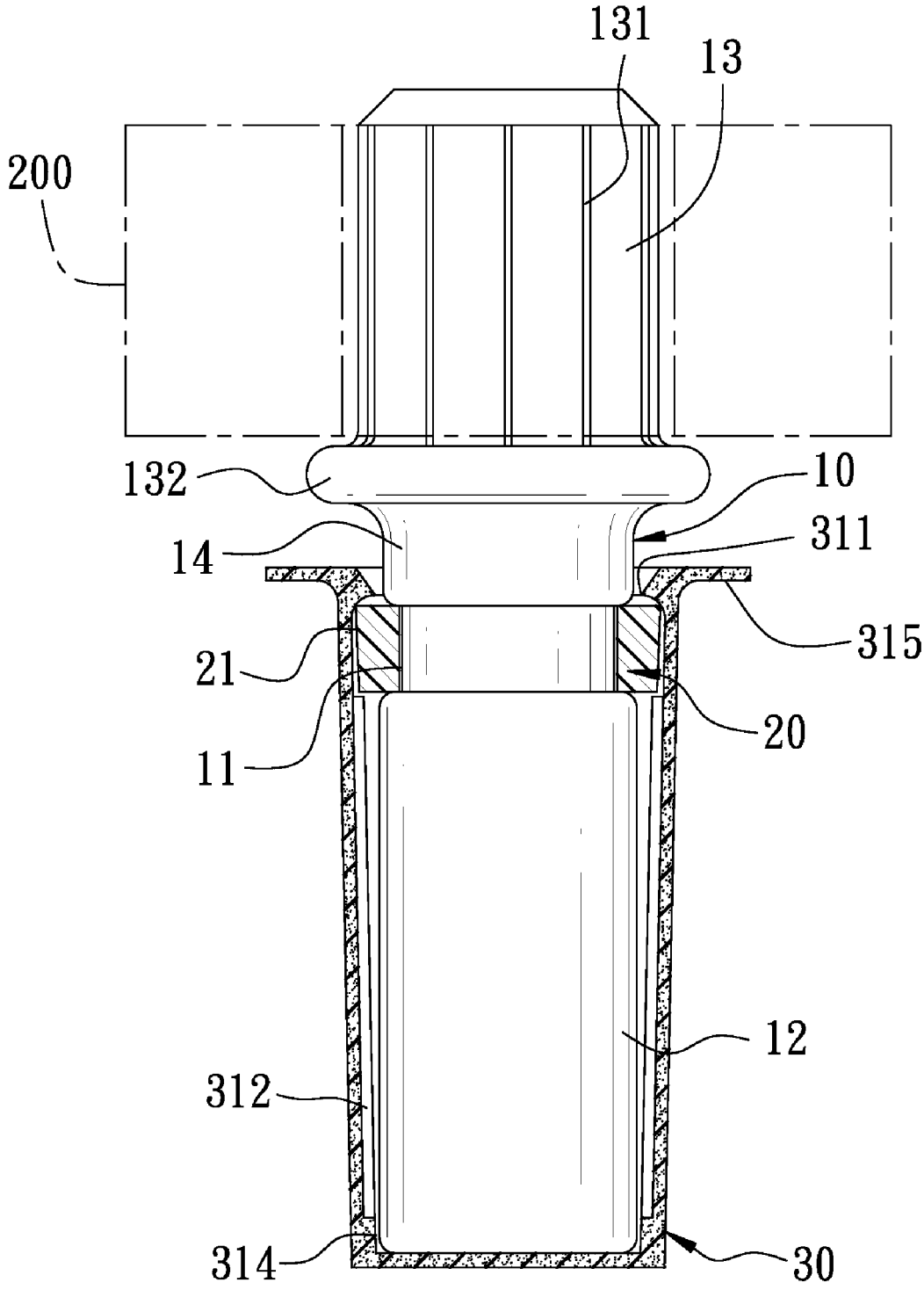
FIG. 4 is a cross-sectional view of the membrane dispenser in the present invention.

A preferred embodiment of a membrane dispenser in the present invention, as shown in FIGS. 3 and 4, includes a basic body 10, a position-limiting member 20 and brake sleeve 30 combined together.

The basic body 10 is a long cylindrical body having its intermediate circumference bored with a position-limiting recess 11, which partitions the basic body 10 into a holding member 12 at a rear portion and a wheel hub-shaped dispensing member 13 with a diameter larger than the holding member 12 at a front portion. The dispensing member 13 to be tightly assembled with the inner center of a membrane reel 200 has its outer circumference fixed thereon with a plurality of projecting ribs 131 spaced apart equidistantly and has its rear end contracted toward the position-limiting recess 11 and formed with a neck 14 somewhat equivalent to the holding member 12 in diameter, having an annular projecting member 132 provided between the dispensing member 13 and the neck 14 to be fitted with the membrane reel 200 on the dispensing member 13.

The position-limiting member 20 is ring-shaped and formed by combining two semi-circular members together to be received in the position-limiting recess 11. The inner diameter of the position-limiting member 20 is a little larger than the outer circumference of the position-limiting recess 11 so that the basic body 10 can pivotally rotate on the position-limiting member 20. Further, the position-limiting member 20 has its outer circumference formed with a conical surface 21 gradually narrowed toward the holding member 12.

The brake sleeve 30 is a hollow tubular body made of flexible rubber, having its lower end sealed and its upper end formed with an opening. The brake sleeve 30 is formed with an accommodating cavity 31 with a diameter somewhat larger than the diameter of the holding member 12 of the basic body 10, and the accommodating cavity 31 is deep enough for receiving therein both the holding member 12 and the position-limiting recess 11 of the basic body 10, with the lower end of the holding member 12 exactly resisting on the bottom of the accommodating cavity 31. Thus, the brake sleeve 30 together with the holding member 12 can be properly held for carrying out membrane strapping. Further, the accommodating cavity 31 has an inner circumferential edge of its opening end formed with a conical position-limiting edge 311 gradually extending toward a shaft center and has an inner circumferential surface axially secured thereon with a plurality of rib-shaped brake bars 312 spaced apart equidistantly at a proper location under the position-limiting edge 311. An engage recess 313 is formed between the position-limiting edge 311 and the brake bars 312, having a size exactly equivalent to the size of the outer circumference of the position-limiting member 20 so that the position-limiting member 20 can be received in the engage recess 313 and firmly engaged on the inner circumference of the brake sleeve 30. In addition, the accommodating cavity 31 has a bottom edge of its inner circumference formed with a shoulder 314 facing a shaft center and having a comparatively small diameter to let the lower end of the holding member 12 to be exactly positioned in the shoulder 314. Moreover, the brake sleeve 30 has an outer circumference of its opening end disposed with a flange 315 expanded outward horizontally for preventing a user's hand from touching membrane when the membrane reel 200 is operated to release membrane for use.

In assembling and using, firstly, the position-limiting member 20 is fitted in the position-limiting recess 11 of the basic body 10, and holding member 12 of the basic body 10 is fitted in the accommodating cavity 31 of the brake sleeve 30, letting the position-limiting edge 311 of the brake sleeve 30 resist against the bottom of the position-limiting member 20. Next, the dispensing member 13 is held to press the basic body 10 to be fitted in the accommodating cavity 31 and firmly engaged in the engage recess 313 under the position-limiting edge 311 by means of the position-limiting member 20. At this time, the position-limiting member 20 is restrictedly positioned and engaged in the engage recess 313 by the position-limiting edge 311, and the holding member 12 has its lower outer circumference exactly positioned in the shoulder 314 of the accommodating cavity 31 to enable the basic body 10 to rotate pivotally in the brake sleeve 30, thus finishing assembling of the membrane dispenser. Subsequently, the dispensing member 13 of the membrane dispenser is inserted in an inner center of the membrane reel 200 and has its ribs 131 tightly securing the membrane reel 200 in position to enable the membrane reel 200 to rotate together with the basic body 10.

Figure 5:
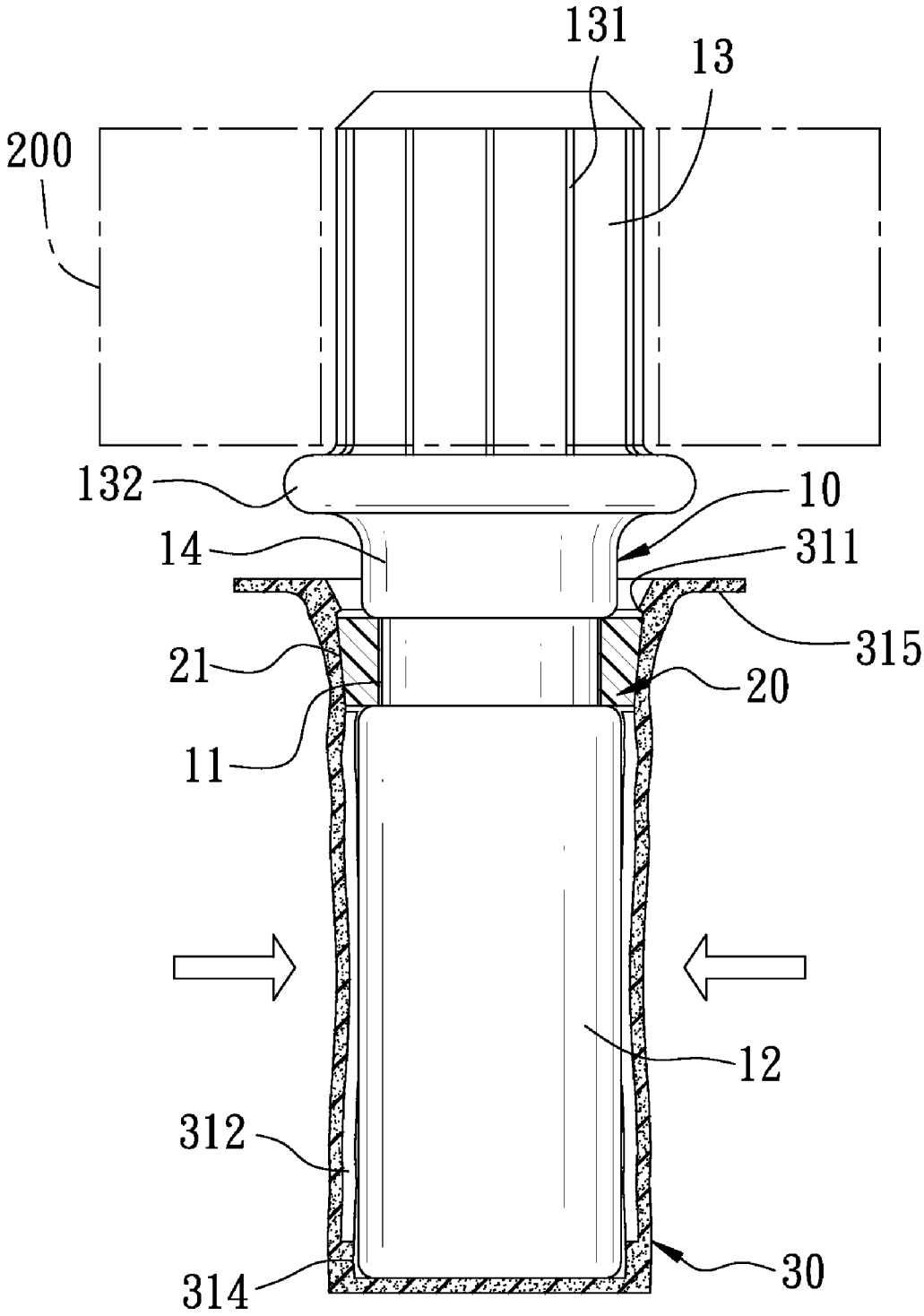
FIG. 5 is a cross-sectional view of the membrane dispenser in a using condition in the present invention.

To carry out membrane strapping on an article, the brake sleeve 30 is held to move on the article in a preset direction to force the basic body 10 to rotate and actuate the membrane reel 200 to release membrane smoothly. In addition, referring to FIG. 5, a radial force can be timely applied to the brake sleeve 30 to make the brake sleeve 30 deformed and compressed to force the brake bars 312 on its inner circumference to resist against the rotating basic body 10 and stop the membrane reel 200 from releasing membrane. At this time, the brake sleeve 30 is continuously held for facilitating adjusting membrane strapping tightness and controlling membrane tension, and then the brake sleeve 30 is released from the radial force for continuously carrying out strapping work. Thus, by operating the brake sleeve 30, the membrane reel 200 can be timely stopped from releasing membrane to enable a user to adjust membrane strapping tightness, achieving excellent effect in membrane strapping.

To sum up, the position-limiting member of this invention is firmly engaged in the interior of the brake sleeve, and the basic body can pivotally rotate on the position-limiting member and actuate the membrane reel to rotate together. By so designing, a user can hold the brake sleeve and timely apply a radial force to let the basic body stop rotating and the membrane reel stop releasing membrane for adjusting strapping tightness of the membrane, able to attain good effect in membrane strapping, easy and convenient in using and economical in materials as well as in labor of strapping.

While the preferred embodiment of the invention has been described above, it will be recognized and understood that various modifications may be made therein and the appended claims are intended to cover all such modifications that may fall within the spirit and scope of the invention.

I claim:

1. A membrane dispenser comprising:

A basic body being a long cylindrical body having its intermediate outer circumference provided with a position-limiting recess, said position-limiting recess partitioning said basic body into a holding member at a rear portion and a dispensing member with a comparatively large diameter at a front portion, said dispensing member having its lower circumference contracted toward said position-limiting recess and formed with a neck with a diameter somewhat the same as that of said holding member;

A position-limiting member shaped as a ring to be fitted and positioned in said position-limiting recess of said basic body, an inner diameter of said position-limiting member being a little larger than a circumference of said position-limiting recess to enable said basic body to rotate pivotally on said position-limiting member; and A brake sleeve being a hollow tubular body made of flexible material, said brake sleeve having its lower end sealed and its upper end formed with an opening, said brake sleeve formed with an accommodating cavity with a diameter a little larger than a diameter of said holding member of said basic body, said accommodating cavity having its lower inner circumferential edge provided with a shoulder protruding toward a shaft center and having a comparatively small diameter, said accommodating cavity being deep enough for receiving therein both said holding member and said position-limiting recess of said basic body, said holding member of said basic body having its lower end exactly fitted in said shoulder of said accommodating cavity, said brake sleeve engaged with said position-limiting member, said accommodating cavity having an inner circumferential edge of its opening end secured with a position-limiting edge, said accommodating cavity further having its inner circumference fixed with a plurality of brake bars at a preset location under said position-limiting edge.

2. The membrane dispenser as claimed in claim 1, wherein said dispensing member of said basic body is shaped as a wheel hub and has its outer circumference axially disposed with a plurality of ribs spaced apart equidistantly, said dispensing member having its lower circumferential edge fixed thereon with a projecting member facing said neck.

3. The membrane dispenser as claimed in claim 1, wherein said position-limiting member has its outer circumference formed with a conical surface gradually narrowed toward said holding member.

4. The membrane dispenser as claimed in claim 1, wherein said accommodating cavity is formed with an engage recess between said position-limiting edge and said brake bars for receiving said position-limiting member therein.

5. The membrane dispenser as claimed in claim 1, wherein said brake bars are shaped as projecting ribs axially and annularly disposed spaced apart equidistantly on an inner circumference of said accommodating cavity.

6. The membrane dispenser as claimed in claim 1, wherein said position-limiting edge is a conical member gradually protruding from an inner circumferential edge of an opening end of said accommodating cavity to a shaft center.

7. The membrane dispenser as claimed in claim 1, wherein said brake sleeve is provided with a flange protruding outward horizontally at an outer circumference of its opening end.

* * * * *